US009622294B1

(12) United States Patent
Ostanek

(10) Patent No.: US 9,622,294 B1
(45) Date of Patent: Apr. 11, 2017

(54) DEVICE FOR SIMULATING THERMAL CHARACTERISTICS OF A LITHIUM-ION BATTERY

(71) Applicant: Jason K. Ostanek, Springfield, PA (US)

(72) Inventor: Jason K. Ostanek, Springfield, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 322 days.

(21) Appl. No.: 14/242,974

(22) Filed: Apr. 2, 2014

(51) Int. Cl.
*H05B 3/12* (2006.01)
*H05B 1/02* (2006.01)
*H05B 3/44* (2006.01)

(52) U.S. Cl.
CPC ..... *H05B 1/023* (2013.01); *H05B 3/12* (2013.01); *H05B 3/44* (2013.01)

(58) Field of Classification Search
CPC ..... H05B 3/12; H05B 3/44
See application file for complete search history.

(56) References Cited

U.S. PATENT DOCUMENTS 3,373,060 A 3/1968 Gray
3,734,778 A 5/1973 Huf et al.
4,322,484 A 3/1982 Sugalski
5,501,916 A 3/1996 Teramoto et al.
5,849,431 A 12/1998 Kita et al.
5,972,532 A 10/1999 Oweis et al.
6,016,047 A 1/2000 Notten et al.
6,020,084 A 2/2000 Romero et al.
(Continued)

FOREIGN PATENT DOCUMENTS

WO 2013152149 A1 10/2013

OTHER PUBLICATIONS

Ahmad A. Pesaran, Robert Rehn, Ronald Russell, John Crawford, Ed Lewis, "A Unique Calorimeter-Cycler for Evaluating High-Power Battery Modules," slideshow presentation, 13th Annual Battery Conference on Applications and Advances, California State University, Long Beach, California, Jan. 13-16, 1998.
(Continued)

*Primary Examiner* — Brian Jennison
(74) *Attorney, Agent, or Firm* — Howard Kaiser

(57) ABSTRACT

The present invention, as frequently practiced, represents a methodology for carrying out thermal management testing. Inventive practice provides desired temperature characteristics without incurring the safety risks associated with Lithium-ion batteries. An exemplary inventive device includes a spiral-wound electrical resistance heater, and simulates the heat generation profile within a Lithium-ion cell through the use of the resistance heater. The construction of the resistance heater is tailored not only to mimic the localized heating profile of the Lithium-ion cell of interest, but also to match thermal properties of the Lithium-ion cell (such as radial thermal conductivity, axial thermal conductivity, and heat capacity). An exemplary inventive device is constructed out of inert materials and hence is inherently safe to carry out thermal management testing, thereby obviating the need for expensive and time-consuming safety qualifications.

20 Claims, 12 Drawing Sheets

(56) References Cited

U.S. PATENT DOCUMENTS

| | | | | |
|---|---|---|---|---|
| 6,117,584 | A | 9/2000 | Hoffman et al. | |
| 6,838,923 | B2 | 1/2005 | Pearson | |
| 7,442,465 | B2 | 10/2008 | Kim et al. | |
| 8,263,246 | B2 | 9/2012 | Fuhr et al. | |
| 2005/0095505 | A1* | 5/2005 | Ohata ..... | H01M 2/18 429/246 |
| 2012/0301768 | A1 | 11/2012 | Ramamurthi et al. | |

OTHER PUBLICATIONS

Ahmad A. Pesaran, Donald J. Russell, John W. Crawford, Robert Rehn, and Edwin A. Lewis, "A Unique Calorimeter-Cycler for Evaluating High-Power Battery Modules," 13th Annual Battery Conference on Applications and Advances, California State University, Long Beach, California, Jan. 13-16, 1998, Proceedings, Piscataway, New Jersey, Institute of Electrical and Electronics Engineers, Inc., 1998, pp. 127-131.

* cited by examiner $$q = I^2 R$$

$$V = I\left(\frac{1}{R_1^{-1} + R_2^{-1}}\right)$$

$$I_1 = \frac{V}{R_1}$$

$$I_2 = \frac{V}{R_2}$$

$$q_1 = I_1^2 R_1$$

$$q_2 = I_2^2 R_2$$

$$I = I_1 + I_2$$

DEVICE FOR SIMULATING THERMAL CHARACTERISTICS OF A LITHIUM-ION BATTERY

BACKGROUND OF THE INVENTION

The present invention relates to batteries, more particularly to methods and apparatuses for testing thermal characteristics of batteries such as Lithium-ion batteries.

Lithium-ion batteries have become commonplace in many everyday items such as laptops, cell phones, and other portable electronics. Lithium-ion batteries are also used in more demanding environments, such as electric vehicles and military applications. It is known that the performance of Lithium-ion batteries is sensitive to ambient temperature. In addition to the risk of battery failure from overheating, it is desirable for the battery system to maintain uniformity in temperature across the individual cells within the system.

Lithium-ion (Li-ion) batteries are known for risk of fire when operated at higher temperatures, e.g., temperatures above approximately 60° C. Catastrophic failure of Lithium-ion batteries has been known to occur due to "thermal runaway." If the internal temperature of a Lithium-ion battery exceeds an onset temperature, this may result in thermal runaway whereby chemical reaction rates increase uncontrollably, possibly leading to fire and/or explosion. As a historical example, failure of Lithium-ion batteries onboard the Boeing 787 Dreamliner was publicized in 2013. Many product recalls have involved Lithium-ion batteries.

There is growing interest in finding thermal management solutions for alleviating safety concerns associated with high temperatures of operation of Lithium-ion batteries. Companies, universities, and government labs are evaluating various thermal management systems for keeping Lithium-ion batteries cool during operation to avoid failure. In seeking solutions for maintaining cooler operation temperatures of Lithium-ion batteries, investigators wish to minimize risks of damage to property and injury to themselves while they conduct their testing. Current practice of heat transfer testing of Lithium-ion batteries involves complicated and expensive safety procedures.

SUMMARY OF THE INVENTION

In view of the foregoing, an object of the present invention is to provide an improved methodology for reducing risks associating with thermal testing of Lithium-ion batteries.

In accordance with exemplary practice of the present invention, the present invention's thermal simulator includes a substantially cylindrical heater and a substantially cylindrical casing. The heater includes at least one strip, and fits approximately coaxially inside the casing. Each strip is rolled up in a generally cylindrical form, and includes an electrically conductive resistance-heating element that extends approximately the length of the strip. When electrical current is conducted through the at least one strip, the heater is characterized by electrical resistance that differs in at least two regions of the heater. The heater thereby exhibits different thermal characteristics in the at least two regions of the heater.

The present invention represents a new and efficacious solution to the problem of hazardous testing of Lithium-ion batteries. According to exemplary practice, the present invention replaces a real Lithium-ion battery with a device that replicates heat characterizing a Lithium-ion battery. By providing a device that simulates a Lithium-ion battery in terms of its thermal characteristics, the present invention assuages the dangers attendant thermal testing of a Lithium-ion battery. Implementation of an inventive battery-simulation device is suitable for diverse applications, particularly applications involving thermal safety testing of a Lithium-ion battery. Currently of interest to many researchers is the evaluation of new cooling strategies and techniques for maintaining operation of a Lithium-ion battery at a safe temperature.

Exemplary practice of the present invention uses resistive heating to simulate the non-uniform heat generation of a battery. Generally speaking, a thermal heating device converts electricity into heat via "resistive heating." Electrical current conducted through a resistive heating device encounters electrical resistance, which results in heating of the heater element. Resistive heating is independent of the direction of current flow. Inventive practice is frequently directed to simulating the non-uniform heat generation of a Lithium-ion battery. Nevertheless, inventive practice can be directed to simulation of a variety of other battery types, such as lead-acid batteries.

Advantages of inventive practice include simulative accuracy and testing safety. Inventive practice can alleviate safety concerns when testing different thermal management solutions. A Lithium-ion battery can be tested with great effectiveness in a laboratory environment using an inventive battery-simulation device, which has none of the safety concerns associated with Lithium-ion batteries. An inventive test device can be used to safely test battery cooling techniques while accurately simulating the physics of an actual Li-ion battery. Inventive practice simulates the operation of a Li-ion battery without actually using the hazardous materials found in these batteries. Hence, inventive practice effects heat transfer testing without necessitating the costly and intricate safety procedures associated with conventional Li-ion battery testing. An inventive Li-ion battery simulator is inherently much safer than an actual Li-ion battery.

Heat transfer tests implementing the inventive battery simulator may achieve a good first-order approximation of how a battery behaves when being cooled by different heat transfer methods. Based on results inventively obtained, a numerical thermal model may be developed to predict the local temperatures within a battery. Thermal models can be incorporated into existing electrical models for batteries.

Exemplary inventive practice implements a resistive heater within an encasement that is similar to the cartridge or shell that typifies a Lithium-ion battery. The resistive heater element is wound up tightly with an insulative separator akin to material used in an actual battery to electrically insulate consecutive windings of the resistive heater. In a typical battery, a separator is a membrane placed between the battery's anode and cathode, thus keeping the two electrodes apart to prevent electrical short circuits.

The wound resistive heater element has a "jelly-roll" configuration similar to that of an actual battery, except without the need for flammable electrolyte solution. According to some inventive embodiments, the resistive heater is manufactured as a serpentine electrically conductive metal foil strip, which is then sandwiched in electrically nonconductive (insulative) Kapton tape, which adds structural integrity. This serpentine strip heater sandwiched in Kapton is then used in conjunction with a separator to form the jelly-roll.

To mimic the non-uniform heat generation typical of Lithium-ion batteries, exemplary embodiments of the present invention's serpentine strip heater are constructed with varying "finger-widths" (longitudinal widths or thicknesses of "fingers" of the serpentine strip) and/or varying "finger-spacings" (longitudinal distances between adjacent "fingers" of the serpentine strip). These modes of inventive configurative variation enable the tailoring of the heat generation of the serpentine heater. Local heat generation is proportional to the local cross-sectional area of the heater strips. Therefore, the characteristics of finger-width and finger-spacing of the strips can be implemented to tailor heat generation. In these manners of varying local cross-section area of a resistive heater strip, the heat generation of the inventive simulator is tuned to match that of the actual battery.

Moreover, the alternating heater/separator layering in the jelly-roll can be made to match the axial-conduction resistance and the radial-conduction resistance of the battery, by interchanging the separator for the best match of material. Similarly, the transient time constant of the battery can be fine-tuned with choice of materials in the jelly-roll. Accordingly, thermal characteristics including heat generation distribution, axial thermal conductivity, radial thermal conductivity, and transient time constant can be approximately matched to thermal characteristics of the actual battery. These thermal character matches are inventively accomplished while vitiating test safety concerns.

An exemplary embodiment of the present invention includes a resistance heater, separator material, lead wires, and a Lithium-ion battery case. The resistance heater includes Inconel foil (resistive heating element) sandwiched between Kapton tape (electrically insulative covering) on either side. Materials suitable for a resistance heater of inventive practice include but are not limited to Inconel (which is a registered trademark of Special Metals Corporation) and Nichrome. Materials suitable for an insulative covering include but are not limited to Kapton (which is a registered trademark of DuPont). The skilled artisan who reads the instant disclosure will appreciate that various heater materials and various insulative covering materials may be suitable for inventive practice.

A current is supplied to the Inconel foil circuit, and resistive heating (e.g., Joule heating) occurs according to the equation $Q=I^2R$, where Q is the heat generated (W), I is the current through the circuit (A), and R is the resistance of the Inconel strip (Ω). The Kapton tape provides electrical insulation and also provides structural integrity for the flimsy serpentine circuit. In addition, according to exemplary inventive embodiments, the Kapton tape preserves the spacing between the "fingers" (transverse members) of an undulatingly configured resistive heating element.

The serpentine circuit is engineered to achieve the proper heat transfer distribution to simulate the operation of a subject Lithium-ion battery. The heater generates more heat where the Inconel strips are thinner. That is, because the strips are thinner and current is assumed to be constant, the electrical resistance increases and the heat generated increases according to $Q=I^2R$. The placements and thicknesses of the strips can be selected to best match the local heat generation profile inside the actual Li-ion battery.

Once the heater has been manufactured, it is layered together with an electrically nonconductive separator material that is chosen to match the thermal properties (e.g., thermal conductivity and heat capacity) of the Li-ion battery of interest. Then the heating element and the separator are rolled up together into a cylinder, and placed inside an empty Li-ion battery case.

According to exemplary inventive practice, an inventive device simulates the non-uniform heat generation of a Li-ion battery. Inventive practice is not subject to an assumption of uniform heat generation. The present invention provides for the practitioner to design the resistive heater so as to account for non-uniform heating in the axial direction of the battery that would be due to the non-uniform current distribution. The electrical current density is more concentrated near the ends of the battery (at the terminals); this causes an increase in heat generation. The current density increases as one moves closer to the terminals.

The present invention also enables an inventive practitioner to account for the temperature-sensitive heat generation that occurs in Li-ion batteries. During operation, the center of the battery becomes hotter than at the boundaries. When the center of the battery is hotter, the reaction rate increases, which results in a greater heating rate at the center of the battery. However, the center of a battery becomes "drained," and the battery begins to draw current from the peripheral regions of the battery, instead of from the center of the battery. Therefore, the heat generation at the peripheral regions increases as the overall state-of-charge of the battery approaches zero. The construction of the invention may be tuned for a single design point, such as near the end of discharge when heat generation occurs more near the peripheries of the cell. Or, the construction of the invention may attempt to capture the time-dependent shift in heat generation that initiates as uniform (or slightly favoring heat generation at the core) and shifts toward the peripheries as time goes on.

Exemplary inventive practice matches the thermal conductivity and heat capacity of the subject battery through material selection of the components of the resistive heating unit, including the resistive heater element(s) and the separator(s). Axial-thermal-conductivity, radial-thermal-conductivity, and heat capacity may be adjusted to match the actual battery through the thicknesses and choices of materials in the jelly-roll heating unit.

BRIEF DESCRIPTION OF THE DRAWINGS

The present invention will now be described, by way of example, with reference to the accompanying drawings, wherein:

FIG. 10 shows the generally axial-longitudinal flow of electrical current that enters the inventive battery simulator via a first lead, passes through the inventive battery simulator, and exits the inventive battery simulator via a second lead.

FIG. 6 illustrates a regular (homogeneous) undulative form of the heating element.

FIG. 20 through 22 each illustrate an irregular (heterogeneous) undulative form of the heating element. FIG. 20 shows a heating element in which the transverse members ("fingers") of the heating element are lengthwise constant in thickness; however, in at least two sections of the heating element, the transverse members differ in spacing therebetween. FIG. 21 shows a heating element in which the transverse members (fingers) of the heating element are lengthwise constant in spacing; however, in at least two sections of the heating element, the transverse members differ in thickness. FIG. 22 combines elements of the heating element shown in FIGS. 20 and 21, respectively. FIG. 22 shows a heating element in which, in at least two sections of the heating element, the transverse members differ in both thickness and spacing.

FIG. 23 illustrates a continuous-sheet form of the heating element (e.g., metal foil).

FIG. 24 shows two longitudinally adjacent zones constituted by separate, congruous, undulative heating sub-elements. FIG. 25 shows two longitudinally adjacent zones constituted by separate, congruous, continuous-sheet heating sub-elements. In each figure, the two heating sub-elements are longitudinally juxtaposed and then rolled up together. The two adjacent heating sub-elements differ from each other in material and correspondingly in electrical resistance, thus differing from each other in terms of thermal character.

DESCRIPTION OF EXEMPLARY EMBODIMENTS OF THE INVENTION

Figure 2:
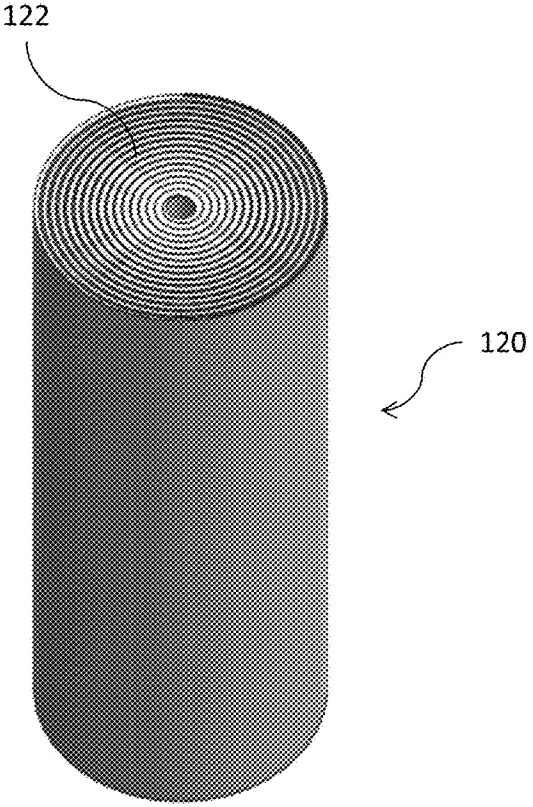
FIG. 2 is a diagrammatic perspective view of an exemplary embodiment of an encased resistive heating element of an inventive battery simulator such as shown in FIG. 1.

Referring now to the figures and particularly to FIGS. 1 through 7, inventive battery simulator 100 includes a cylindrical casing 110 and a resistive heating unit 120. Electrically conductive casing 110 is characterized by a geometric longitudinal axis a, and is same as or similar to a metal casing of a battery such as a Lithium-ion battery. Electrically conductive, resistively heating unit 120 is contained inside casing 110. Casing 110 includes an open-ended hollow cylindrical enclosure 112 and a circular lid/cap 114, which is situated at the open end of the cylindrical enclosure 112. Cylindrical enclosure 112 is shaped like a can.

Heating unit ("heater") 120 includes at least one rolled-up strip 122, and coaxially fits inside casing 110. Each strip 122 is capable of electrical conduction and resistive heating, and is wound about itself in an approximately cylindrical "jelly-roll" configuration. A strip 122 describes a non-helical (geometrically planar) winding, spiraled or coiled about a geometric central point in a geometric plane. The terms "spiral" and "coil" are used interchangeably herein to refer generally to a geometric configuration characterized by coaxial, increasingly large, winding circles. A spindle, mandrel, human finger, or other device can be used for effecting such windings of strips 122.

Figure 3:
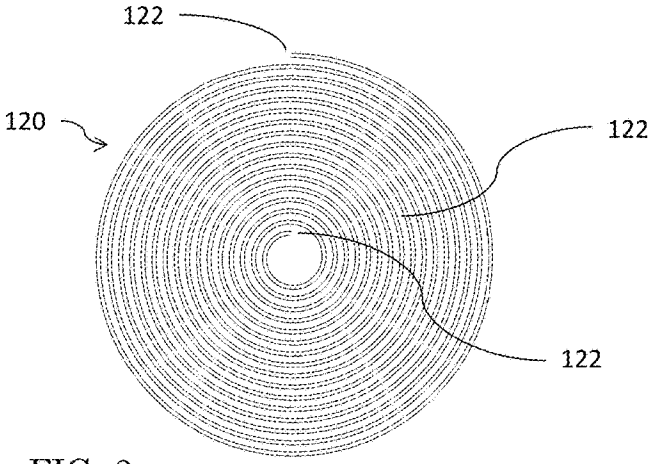
FIG. 3 is a diagrammatic axial view of an exemplary embodiment of a "uni-zonal" resistive heating element in accordance with the present invention.
Figure 5:
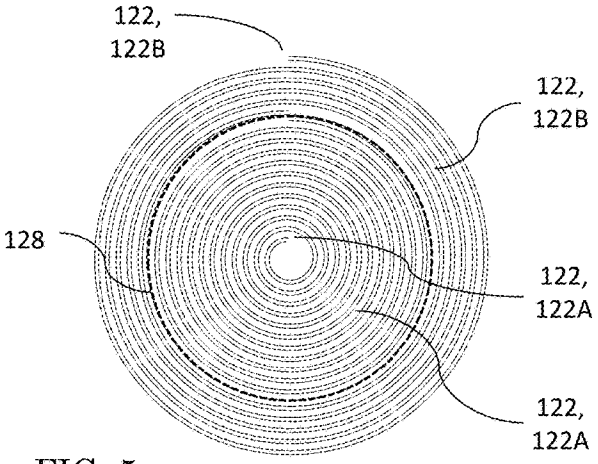
FIG. 5 is a diagrammatic axial view of an exemplary embodiment of a "bi-zonal" resistive heating element in accordance with the present invention.
Figure 4:
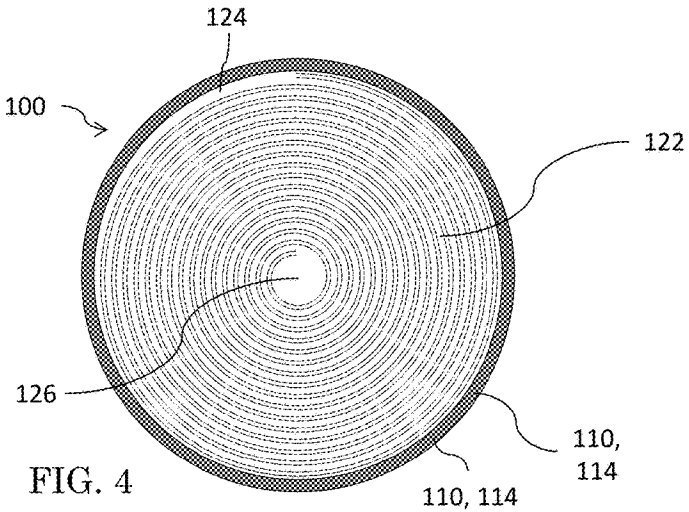
FIG. 4 is a view similar to the view of FIG. 3, showing the uni-zonal resistive heating element housed in a casing.
Figure 6:
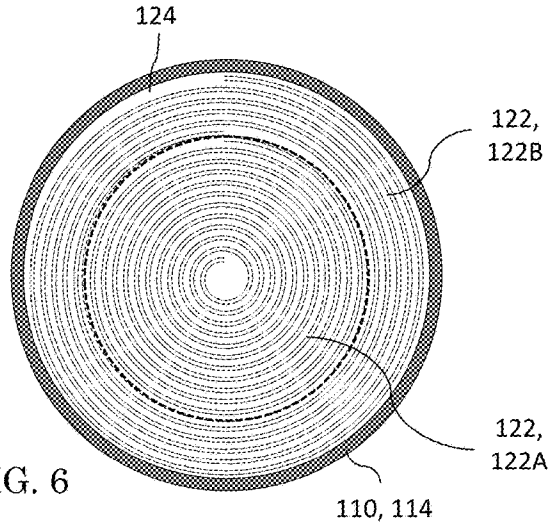
FIG. 6 is a view similar to the view of FIG. 5, showing the bi-zonal resistive heating element housed in a casing.
Figure 7:
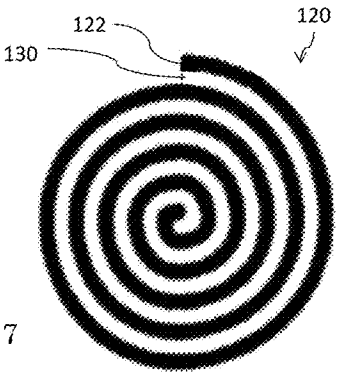
FIG. 7 is a diagrammatic plan view of an exemplary embodiment of an electrically conductive, resistively heating strip that is included in a jelly-roll-configured resistive heating unit in accordance with the present invention.

With the heating unit 120 in place inside casing 110, an approximately cylindrical interface 124 and an approximately axial-longitudinal void 126 are described. Cylindrical interface 124 exists between the exterior surface of heating unit 120 and the interior surface of casing 110. Longitudinal void 126 exists along axis a. FIGS. 3 and 4 show a single winding, viz., a single rolled-up resistance-heating strip 122 characterized by a jelly-roll configuration. FIGS. 5 and 6 show a two-zone winding, viz., two coaxial rolled-up resistance-heating strips 122, each strip 122 characterized by a jelly-roll configuration. As compared with single-zone practice of the present invention, a possible advantage of plural-zone practice of the present invention may be a better capability of "tailoring" the heat generation rate of the inventive simulator 100.

According to the "radial zonality" illustrated in FIGS. 5 and 6, the first "zone" of heating unit 120 corresponds to an inner strip 122A; the second "zone" of heating unit 120 corresponds to an outer strip 122B. Strips 122A and 122B border upon each other and describe therebetween an approximately cylindrical geometric demarcation 128. Inner rolled-up strip 122A is more tightly wrapped about axis a of casing 110, whereas outer rolled-up strip 122B is more loosely wrapped about axis a of casing 110. For instance, inner strip is closely wound about geometric axis a, and outer strip 122B is wound around inner strip 122A. Strips 122A and 122B together describe a substantially integral resistive heating unit 120.

Figure 8:
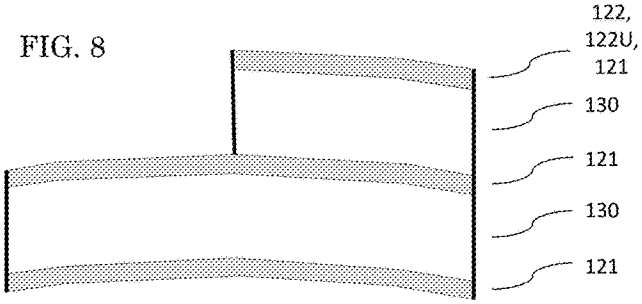
FIG. 8 is a diagrammatic partial plan view of an exemplary inventive embodiment of an electrically conductive, resistively heating strip that is included in a jelly-roll-configured resistive heating unit. The extreme peripheral end region of the strip is shown in FIG. 8. According to the inventive embodiment shown in FIG. 8, the heat-resistance strip consists essentially of a metal heat-resistance element. The resistive-heating element is rolled up together with an insulating separator strip, thus forming the jelly-roll configuration of the resistive heating unit. The single-layer resistive-heating strip is thereby separated from itself within the jelly-roll configuration by an insulating separator strip.
Figure 9:
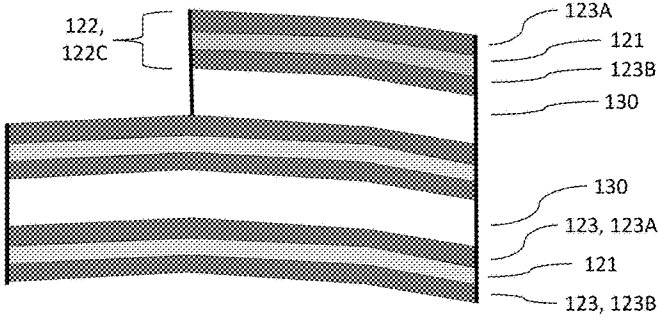
FIG. 9 is a diagrammatic partial plan view of a different exemplary inventive embodiment of an electrically conductive, resistively heating, jelly-roll-configured strip that is included in a resistive heating element. The extreme peripheral end region of the strip is shown in FIG. 9. According to the inventive embodiment shown in FIG. 9, the resistance-heating strip includes a metal heat-resistance element and an insulating material covering both sides of the heat-resistance element. The triple-layer resistive-heating strip is rolled up together with an insulating separator strip, thus forming the jelly-roll configuration of the resistive heating unit. The triple-layer resistive-heating strip is thereby separated from itself within the jelly-roll configuration by an insulating separator strip.

With reference to FIGS. 8 and 9, a strip 122 can be embodied as either uncovered, or covered with insulating material. As shown in FIG. 8, an uncovered strip 122U consists essentially of a resistance-heating element 121, for instance made of an electrically conductive metal material. As shown in FIG. 9, a covered strip 122C includes a resistance-heating element 121 and insulative coverings (insulative outer layers, e.g., plastic) 123A and 123B, situated on both sides of resistance heating element 121.

Usual practice of the present invention provides for electrically insulative separation of adjacent or adjoining portions of rolled-up strip 122. FIGS. 8 and 9 each focus upon a small region of heating element 120 at its peripheral end. FIG. 8 shows an electrically nonconductive (e.g., plastic) separator strip 130 being wound together with a strip 122 that consists essentially of resistance-heating element 121, thereby forming a rolled-up configuration of two contiguous layers of heating strip 120. A first layer is formed by electrically conductive strip 122. A second layer is formed by electrically insulative separator strip 130.

As distinguished from the two-layer system shown in FIG. 8, FIG. 9 shows a four-layer system. Resistance-heating conductive strip 122 includes a heating element 121 and an insulative covering 123, bonded to each of the opposite surfaces of heating element 121. Accordingly, a first layer is formed by first insulative coating 123A; a second layer, next to the first layer, is formed by electrically conductive strip 121; a third layer, next to the second layer, is formed by second insulative coating 123B; a fourth layer, next to the third layer, is formed by electrically insulative separator strip 130. The second layer is between the first and third layers; the third layer is between the second and fourth layers.

Thus, the four-layer system shown in FIG. 9 has: a strip 122 that includes heating element 121 and two insulative layers 123 bonded to heating element 121; and, an insulative separator 130 adjacent to strip 122. In contrast, the two-layer system shown in FIG. 8 has: a strip 122 that includes heating element 121 but does not include bonded insulative layers 123; and, an insulative separator 130 adjacent to strip 122.

Inventive practice is possible with plural separator layers. For instance, a five-layer system can include an insulated heating element, a metal separator (e.g., copper) next to the insulated heating element, and a plastic separator next to the metal separator. Each of the two separator layers serves not only to enhance the structural integrity of the jelly-roll, but also to influence the thermal character of the jelly-roll. Copper, for instance, is characterized by high thermal conductivity. As another example, a multi-layer system that includes a non-insulated heating element can include a metal (e.g., copper) separator, provided that the non-insulated heating element is shielded from the metal separator via a plastic separator. An electrically conductive (metal) separator must not be in direct contact with a heating element, as this would cause an electrical short circuit.

Figure 10:
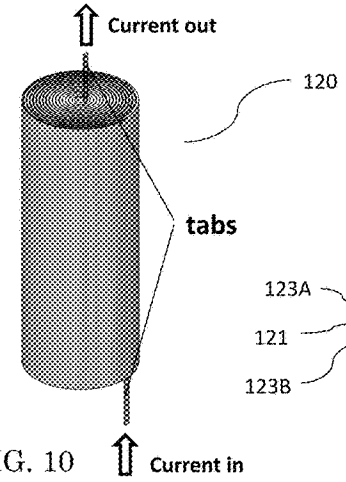
FIGS. 10 and 11 are views similar to the views of FIGS. 2 and 1, respectively, additionally showing the generally axial-longitudinal direction of the flow of electrical current passing through an exemplary embodiment of an inventive battery simulator.
Figure 11:
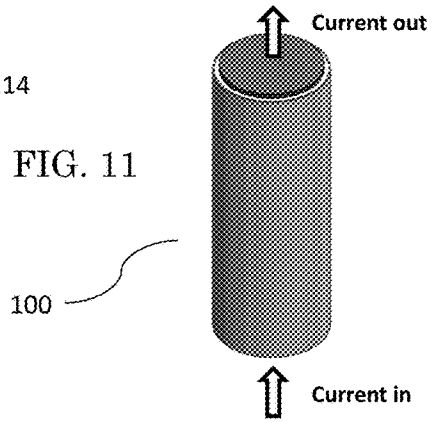

Referring to FIGS. 10 through 14, heating unit 120 has connected thereto two electrodes or leads, referred to herein as electrically conductive "tabs" 136, viz., central tab 136A and peripheral tab 136B. Central tab 136A is attached to and projects from a heating element 121 at a location proximate void 126. Peripheral tab 136B is attached to and projects from a heating element 121 at a location proximate interface 124. As depicted in FIG. 10, in operation of battery simulator 100, direct electrical current enters battery simulator 100 at the bottom via peripheral tab 136B, is conducted through battery simulator 100 through the resistance-heating strip or strips 122 in a generally axial direction, and exits battery simulator 100 at the top via central tab 136A. The current in equals the current out.

Figure 1:
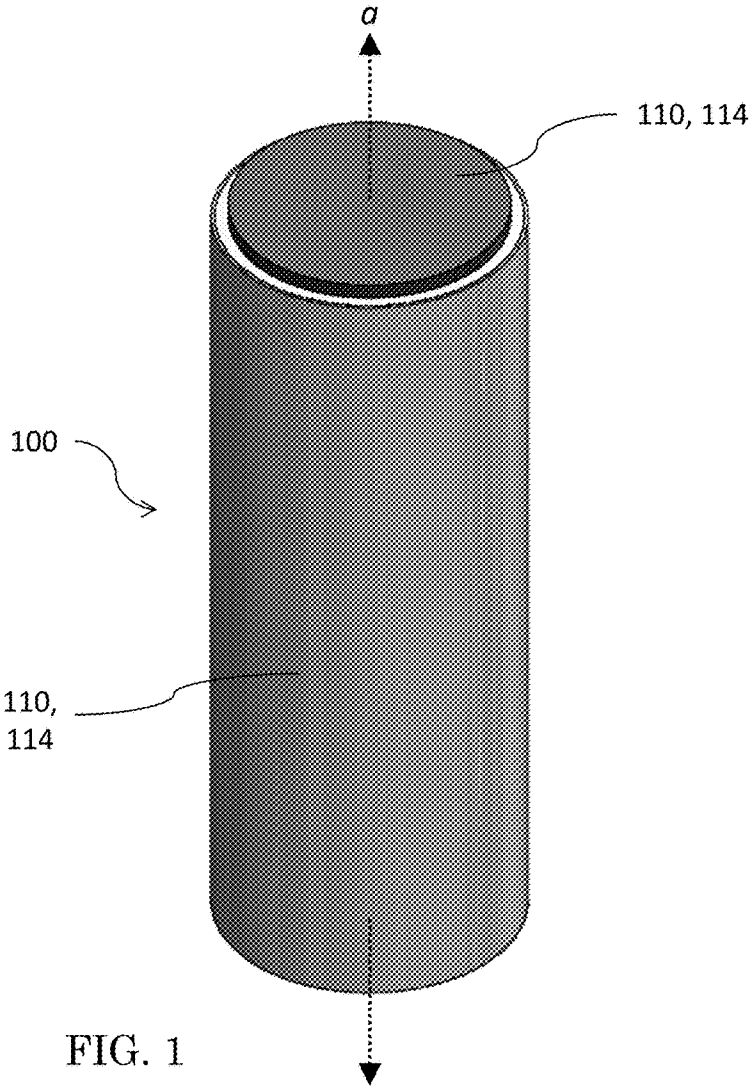
FIG. 1 is a diagrammatic perspective view of an exemplary embodiment of a battery simulator in accordance with the present invention, in particular depicting the outer casing of the inventive battery simulator.
Figure 12:
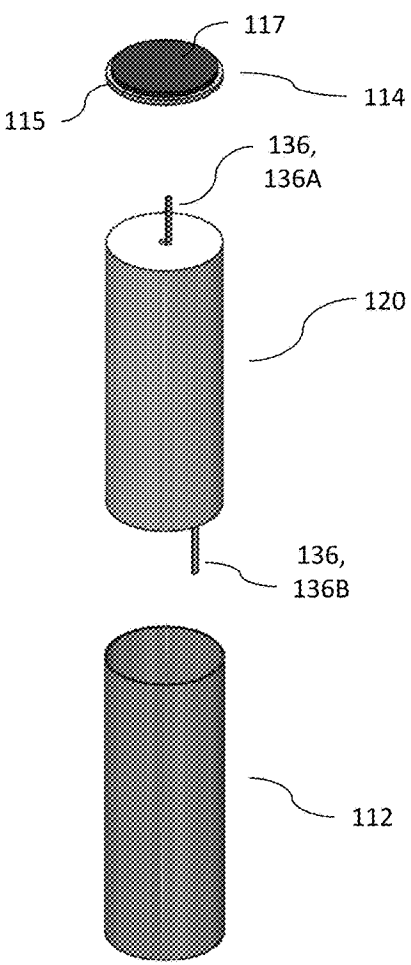
FIGS. 12 and 13 are diagrammatic exploded views illustrating, by way of example, fabrication of a battery simulator in accordance with the present invention. The four main constituents depicted are the cap/lid part of the casing, the can part of the casing, the resistive heating element, and the pair of leads.
Figure 13:
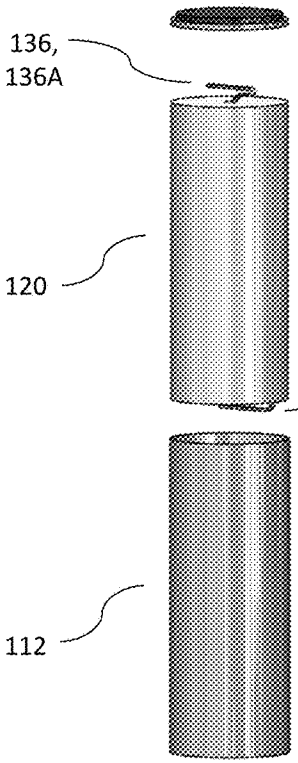

FIGS. 12 and 13 illustrate fabrication of battery simulator 100. According to exemplary practice of the present invention, the four major constituents of battery simulator 100 are metal "can" 112, partially metal cap 114, at least partially metal heater 120, and metal tabs 136. Cap 114 has, around its circumference, an insulative ring 115, which serves to prevent the metal portion 117 of cap 114 from touching metal can 112. Particularly as shown in FIG. 13, heating unit 120 is inserted inside metal can 112. Each tab 136 is bent and attached to casing 110, for instance by spot welding. Prior or subsequent to insertion of heating unit 120, central tab 136*a* is attached (e.g., using a spot weld) to cap 114. Subsequent to insertion of heating unit 120, peripheral tab 136*b* is attached (e.g., using a spot weld) to metal can 112. The result is the finished inventive product, viz., battery simulator 100, such as shown in FIG. 1.

Figure 14:
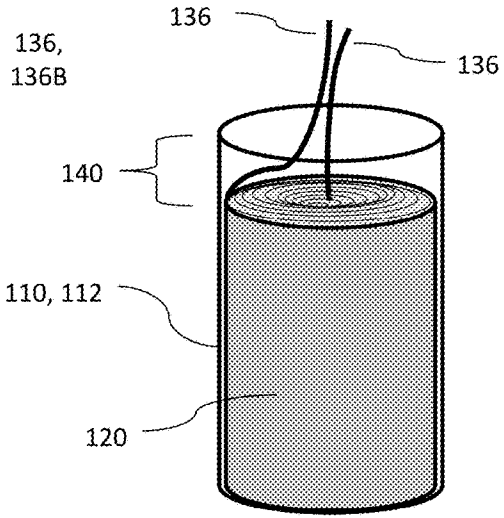
FIG. 14 is a diagrammatic perspective see-through view of an exemplary embodiment of a battery simulator in accordance with the present invention, wherein the external casing transparently reveals the internal resistive heating element, which is shown to be axially-longitudinally shorter than the casing.

As depicted in FIG. 14, the axial length of heating element 120 is less than the axial length of can 112. This deliberate difference in axial lengths leaves a slight or moderate gap 140 between the top of heating unit 120 and the bottom of cap 114. Depending on the inventive embodiment, gap 140 may be an air gap, or may be filled with a dielectric fluid. Since many conventional Lithium-ion batteries are constructed with a void at the top, providing an analogous void 140 in the inventive simulator may serve to further its simulative accuracy with respect to the battery of interest. Note that FIG. 14 shows the lead wires entering and exiting the jelly-roll on the same end of the jelly-roll heating unit. The present invention can be practiced whereby the lead wires are introduced on the same end (either end) of the heating unit, or on opposite ends of the heating unit.

Figure 15:
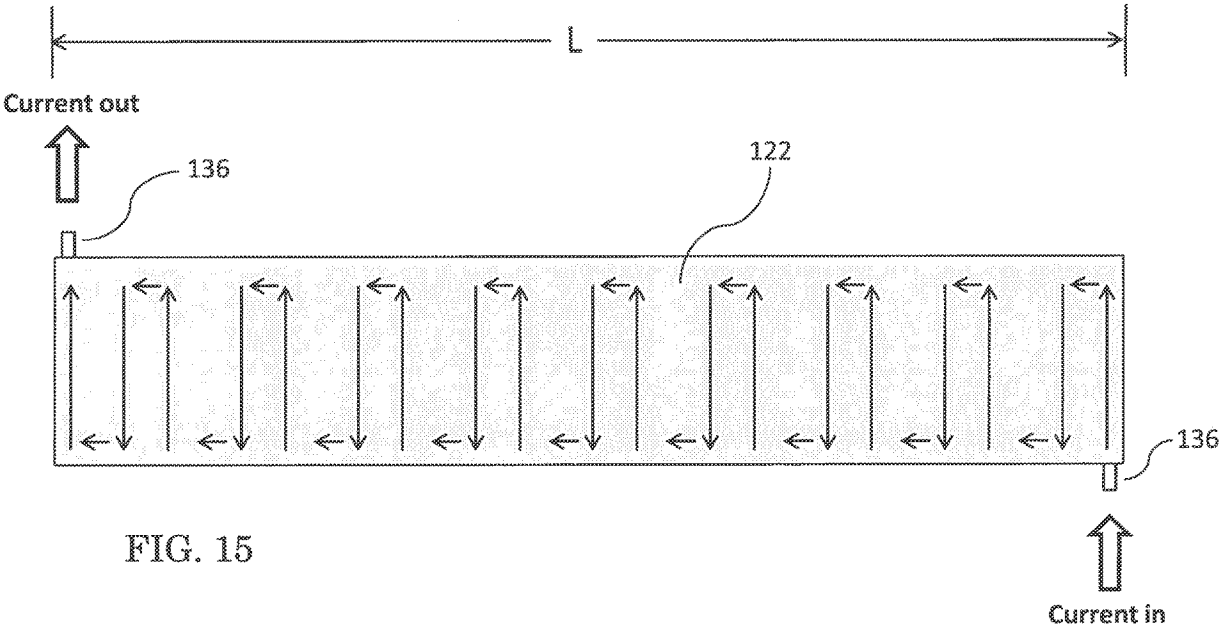
FIG. 15 is a diagram of a resistance-heating strip, particularly illustrating, in a generally representative manner, the flow of electrical current therethrough in accordance with an undulative or serpentine configuration of the resistance-heating metal element of a resistance-heating strip.

FIG. 15 illustrates a representative undulative/serpentine path of electrical current through a strip 122, in accordance with an undulative/serpentine configuration of resistive heating element 121, variously shown by way of the examples in FIGS. 16, 17, 19, 20, 21, 22, and 24. The terms "undulative" and "serpentine" are used interchangeably herein to refer generally to a waveform configuration. Generally speaking, the examples of undulative waveforms illustrated herein are "square" waveforms. The undulative structure of metal element 121 has many transversal members 125, which are parallel to each other and perpendicular to the length L of the strip 122. Although a square waveform represents a propitious undulative genre of a metal foil element 121, the skilled artisan who reads this disclosure will understand that inventive practice is possible implementing diverse undulative genres of element 121.

Figure 16:
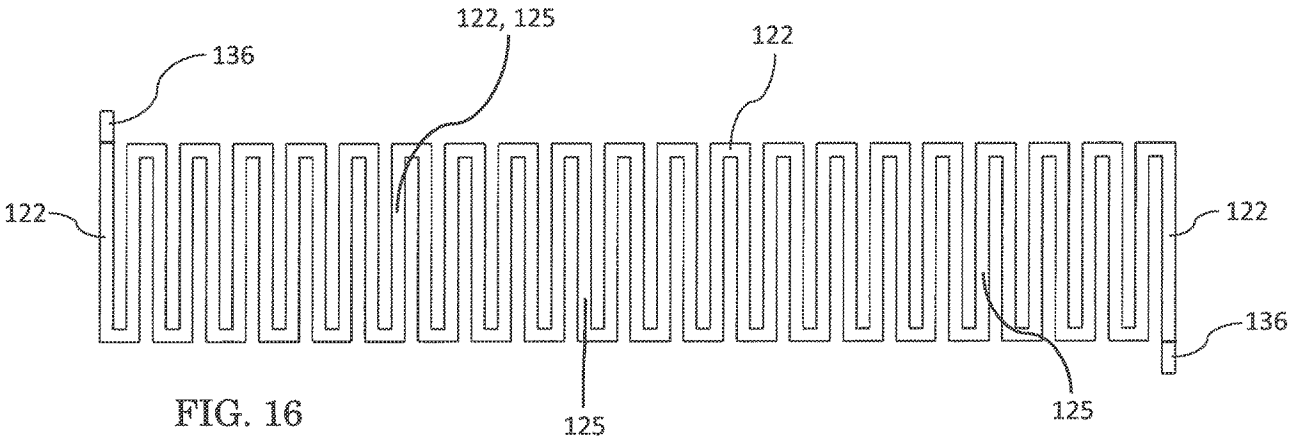
FIG. 16 is a diagram of a heating element (e.g., metal foil) of a resistance-heating strip such as shown in FIG. 15.
Figure 17:
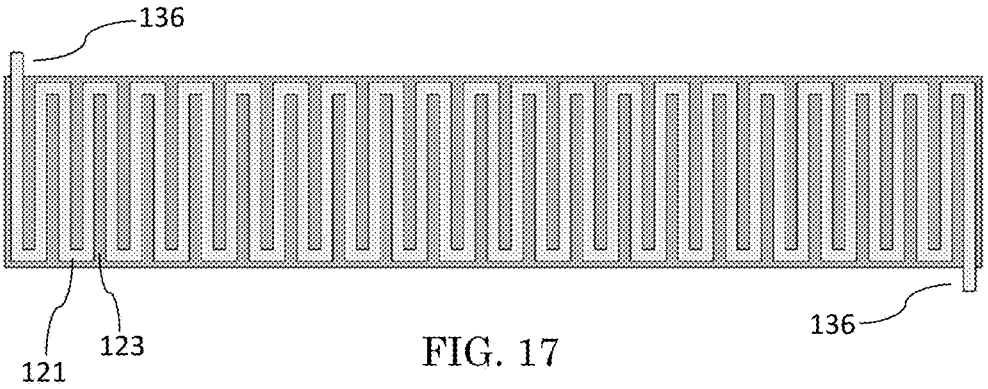
FIGS. 17 through 19 are diagrams illustrating the association of a heating element (similar to that shown in FIG. 16) with respective insulative coverings (e.g., plastic layers) on both sides of the heating element.
Figure 18:
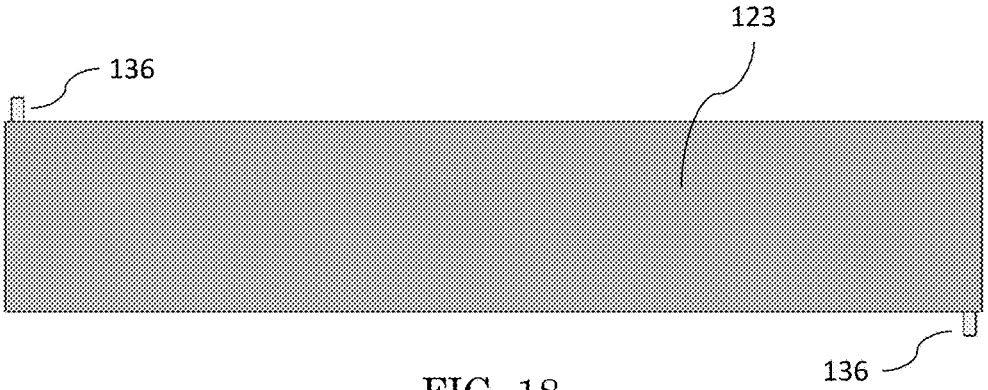
Figure 19:
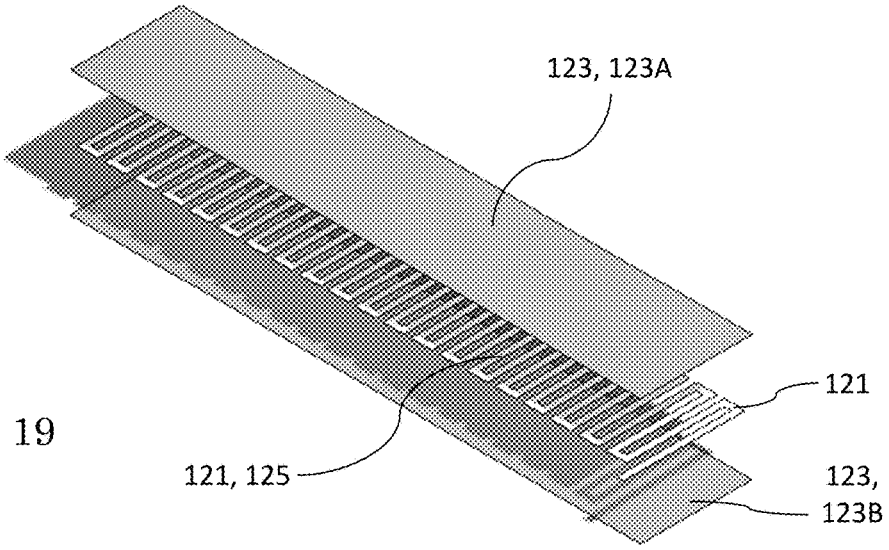

FIG. 16 is illustrative of inventive practice involving implementation of at least one strip 122 that is a metal conductor 121 sans plastic insulation 123. The strip 122 shown in FIG. 16 consists of a bare metal foil 121 having an undulative shape. In contrast, the strip 122 shown in FIGS. 17 through 19 includes a metal conductor 121 and plastic insulation 123, viz., plastic insulation layers 123A and 123B. For illustrative purposes, FIG. 17 shows just one layer 123A of plastic insulation, below the metal foil conductor 121. As shown in FIGS. 18 and 19, the metal foil conductor 121 is sandwiched between the two plastic insulation layers 123A and 123B.

Figure 20:
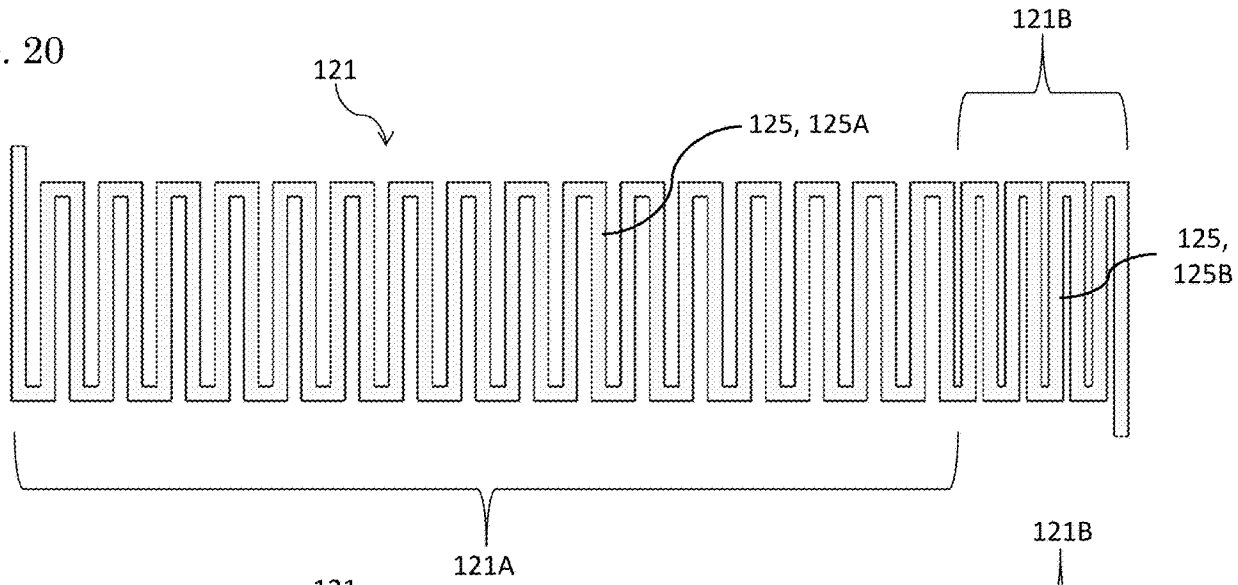
FIGS. 20 through 22 are diagrams, similar to the diagram of FIG. 16, of three other inventive embodiments of a heating element.
Figure 21:
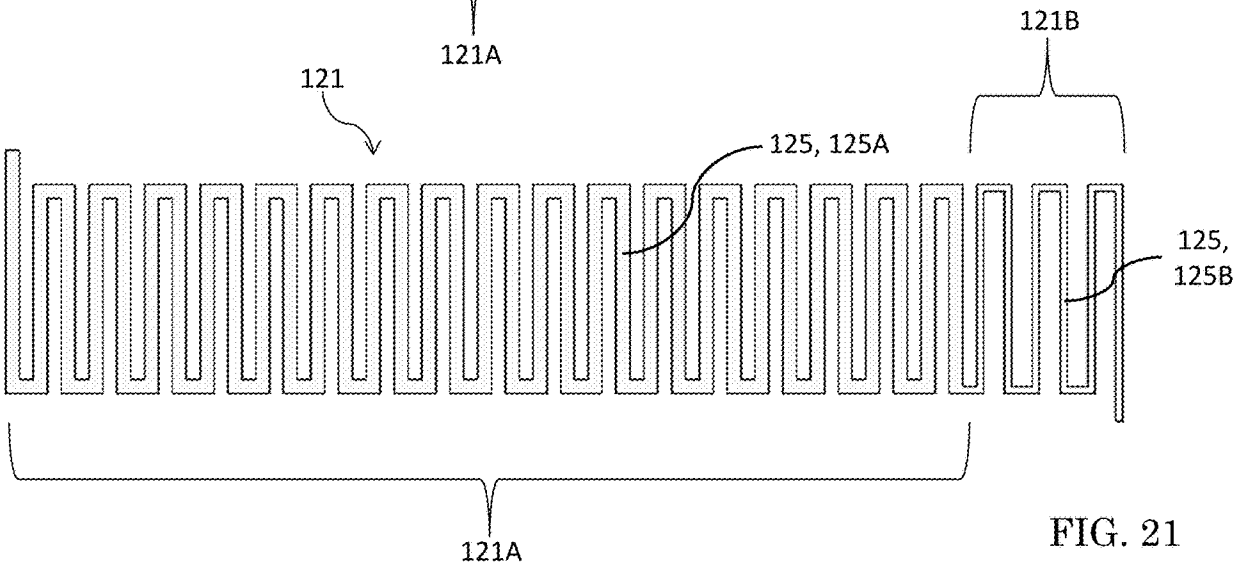
Figure 22:
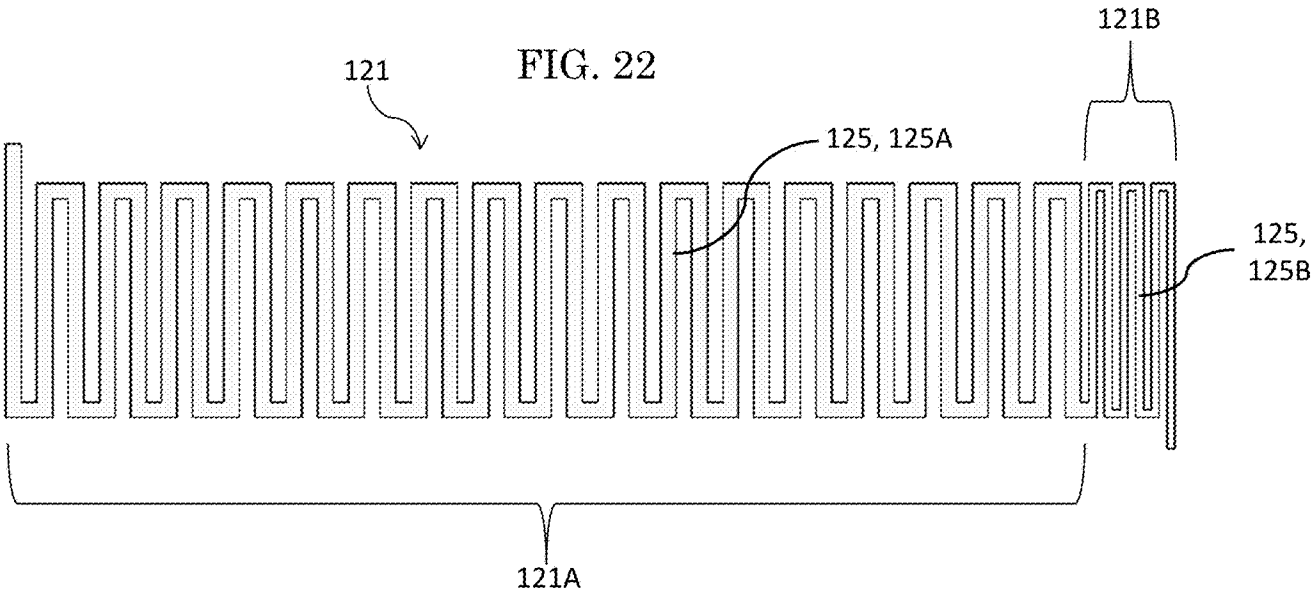

The metal foil element 121 shown in FIG. 16 is constant in "border-width" (width between its longitudinal borders), and is geometrically uniform through its length; in particular, the thicknesses (widths) of the transversal members 125 are constant, and the distances (spacing) between the transversal members 125 are constant. In contrast, FIGS. 20 through 22 respectively show a metal foil element 121 that is constant in border-width but is geometrically non-uniform through its length. Transversal width and/or spacing therebetween can be varied. FIGS. 20 through 22 each illustrate an element 121 that is divided into two adjacent longitudinal sections, viz., an elemental section 121A and an elemental section 121B.

As shown in FIG. 20, the thicknesses of element 121's transversal members 125 are constant through the length of element 121. However, the spacing between the transversal members 125 decreases in elemental section 121B, as compared with elemental section 121A. That is, the distances between the transversal members 125B (in elemental section 125B) are less than the distances between the transversal members 125A (in elemental section 121A).

As shown in FIG. 21, the spacing between element 121's transversal members 125 is constant through the length of element 121. However, the thicknesses of the transversal members 125 decrease in elemental section 121B, as compared with elemental section 121A. That is, the thicknesses of the transversal members 125B (in elemental section 125B) are less than the thicknesses of the transversal members 125A (in elemental section 121A).

The heating element 121 shown in FIG. 22 combines features of the two different heating element 121*s* shown in FIGS. 19 and 20, respectively. As shown in FIG. 21, the spacing between element 121's transversal members 125 decreases in elemental section 121B, as compared with elemental section 121A. That is, the distances between the transversal members 125B (in elemental section 125B) are less than the distances between the transversal members 125A (in elemental section 121A). Furthermore, the thicknesses of element 121's transversal members 125 decrease in elemental section 121B, as compared with elemental section 121A. That is, the thicknesses of the transversal members 125B (in elemental section 125B) are less than the thicknesses of the transversal members 125A (in elemental section 121A).

Figure 23:
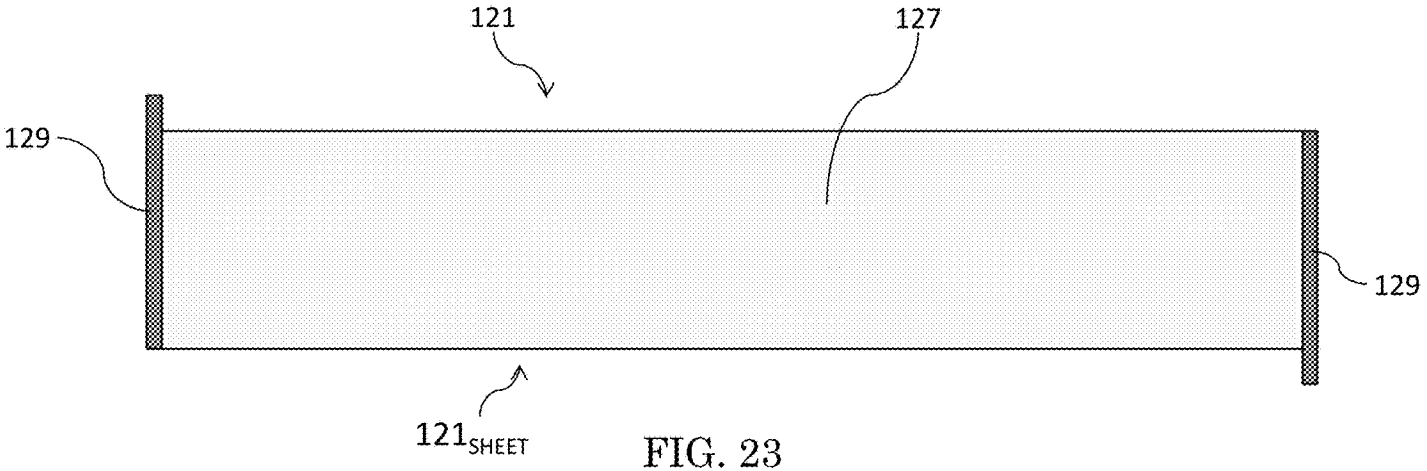
FIG. 23 is a diagram, similar to the diagrams of FIGS. 16 and 20 through 22, of another inventive embodiment of a heating element.

With reference to FIG. 23, some inventive embodiments implement a heating element 121 that is a continuous-sheet (non-serpentine) heating element $\mathbf{121}_{SHEET}$, as distinguished from a serpentine heating element 121 such as exemplified by FIGS. 16, 18, 19, 20, 21, 22, and 24. The heating element $\mathbf{121}_{SHEET}$ shown in FIG. 23 includes a single, rectilinear piece of foil 127 and two end-pieces 129, viz., 129*a* and 129*b*. The sheet foil 127 is constant in border-width along its length, e.g., rectangular. Each end-piece 129 is made of copper or other high conductivity material, and acts as a "bus-bar" serving to evenly spread out the electrical current.

Figure 24:
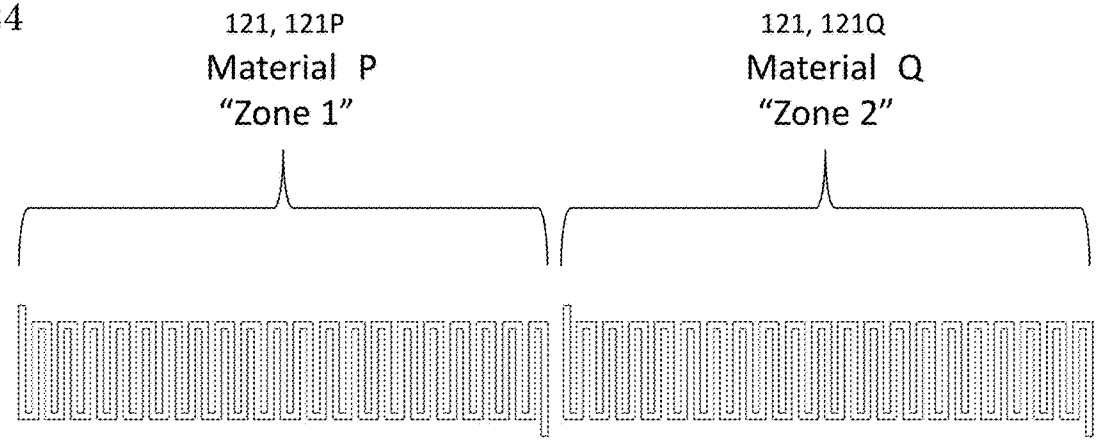
FIGS. 24 and 25 are diagrams each illustrating a "bi-zonal" resistive heating element in accordance with the present invention, such as shown by way of example in FIGS. 5 and 6.
Figure 25:
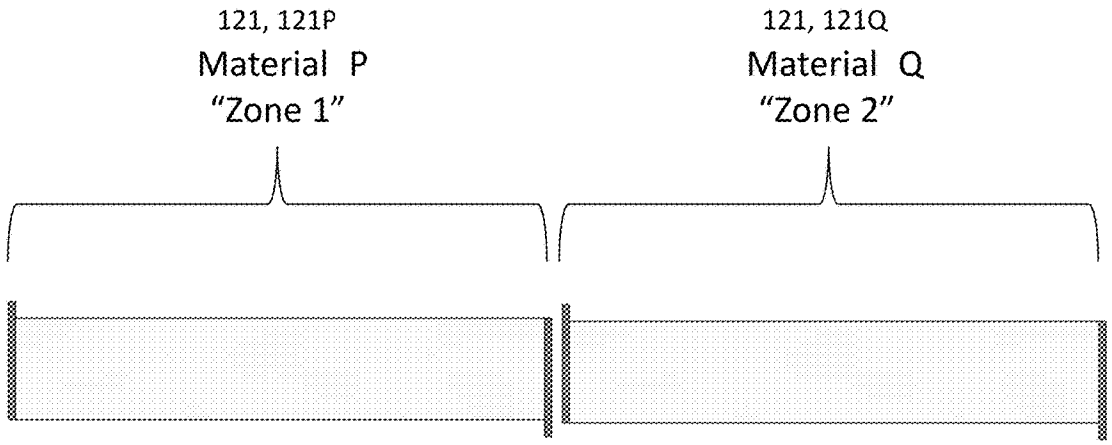

According to exemplary practice of the present invention, at least two strips 122 can be implemented having respective heating elements 121 that differ from each other in terms of material composition, or undulative configuration, or both material composition and undulative configuration. The respective materials and/or configurations of the heating elements 121 differ; consequently, the respective thermal characters of the heating elements 121 differ. FIGS. 24 and 25 are representative of plural-zone winding of strips 122, such as depicted in FIGS. 5 and 6.

For example, two heating elements 121 can be wound together that are dissimilar in terms of material. The two heating elements 121, viz. 121P and 121Q, can be laid down end-to-end, and then rolled up together. Although two strips are shown in FIGS. 24 and 25 by way of example, practically any number of strips can be wound together in inventive practice. As shown in FIGS. 24 and 25, first heating element 121P is constituted by material "P"; second heating element 121Q is constituted by material "Q," which differs from material "P." The thermal characteristics of heating elements 121P and 121Q shown in FIG. 24 differ from each other, albeit heating elements 121P and 121Q have approximately the same undulative configuration. Similarly, the thermal characteristics of heating elements 121P and 121Q shown in FIG. 25 differ from each other, albeit heating elements 121P and 121Q have approximately the same continuous-sheet (non-undulative) configuration.

In FIGS. 24 and 25, the two adjacent heating sub-elements are shown to have the same configuration; hence, their difference in thermal character is associated with their difference in material constitution. According to diverse embodiments of inventive practice, two adjacent heating sub-elements can have: the same configuration but different materials (in which case the different thermal characters are associated with the different materials); or, different configurations but the same material (in which case the different thermal characters are associated with the different configurations); or, different configurations and different materials (in which case the different thermal characters are associated with the different configurations and with the different materials).

The inventive strategy of varying thermal characteristics at varying locations in heater 120 can be carried out by varying geometric configurations (e.g., undulative shapes) and/or by varying material compositions. As exemplified by FIGS. 20 through 22, variation of undulative shapes between or among heating elements and/or heating element sections can be effectuated for two or more serpentine-foil heating elements and/or heating element sections. Variation of material compositions between or among heating elements and/or heating element sections can be effectuated with respect to: two or more serpentine-foil heating elements and/or heating element sections (such as illustrated in FIG. 24); or, two or more sheet-foil heating elements or heating element sections (such as illustrated in FIG. 25); or, one or more serpentine-foil heating elements and/or element sections, and one or more sheet-foil heating elements and/or heating element sections.

Figure 26:
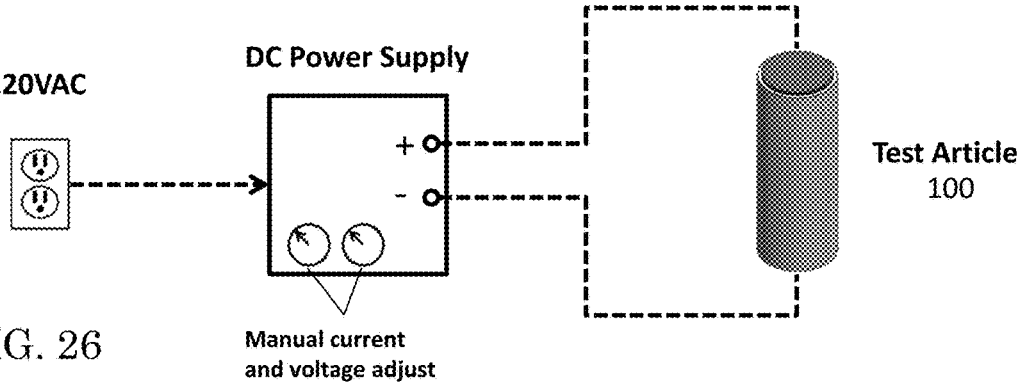
FIGS. 26 through 30 are circuit diagrams and electrical relationships illustrative of implementations of exemplary embodiments of an inventive simulator as a test article.
Figure 27:
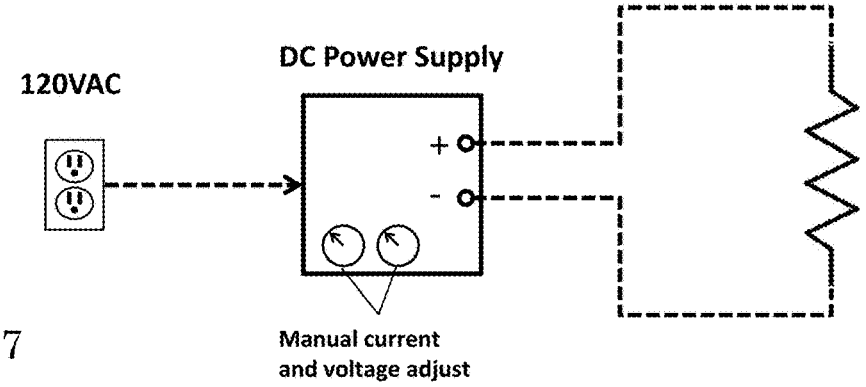

FIGS. 26 through 30 are electrical wiring schematics pertaining to exemplary testing involving inventive simulation of a battery. FIG. 26 shows an exemplary test setup using an inventive simulator 100 as the test article. AC power (e.g., 120 Volts) is supplied to a DC power supply, which is manually adjustable with respect to current and voltage. DC power is supplied to inventive simulator 100. The circuit diagrams and physical equations of FIGS. 27 and 29 correspond to one-zone inventive practice, using a single heating element, such as shown in FIGS. 3 and 4. The circuit diagrams and physical equations of FIGS. 28 and 30 correspond to two-zone inventive practice, using two heating elements, such as shown in FIGS. 5 and 6.

Figure 28:
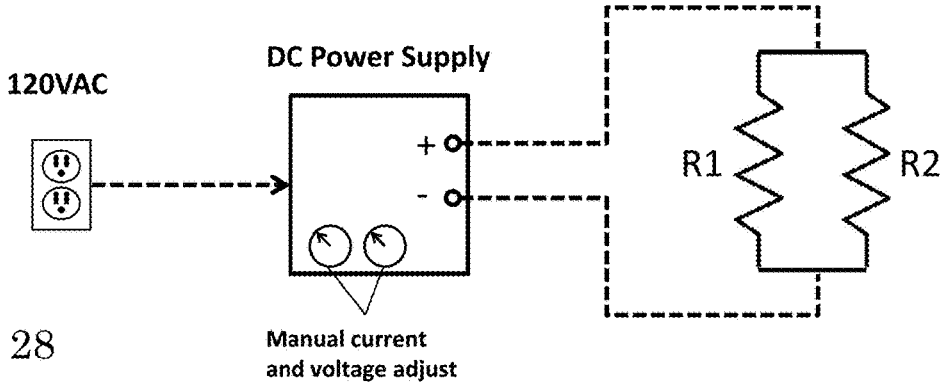
Figure 29:
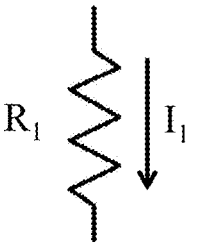
Figure 30:
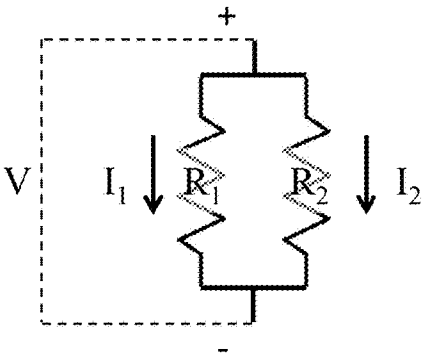

FIGS. 29 and 30 set forth equations for heat generation rate q as related to current I, voltage V, and resistance R. The single-zone design of FIG. 27 and FIG. 29 implements one resistance-heater strip 122. In contrast, the double-zone design of FIG. 28 and FIG. 30 implements two resistance-heater strips 122 which are connected in parallel. The consecutive heater strips may also be connected in series, with the appropriate change in equations for heat generation rate. The inventive practitioner can select materials that have a temperature-dependent resistance. As compared with the one-zone design, the two-zone design may be advantageous insofar as furthering the ability of the inventive practitioner to alter or adjust the heat generation in each zone according to the resistance of each heater strip 122. In particular, the inventive practitioner can select respective materials for the two zones that differ in terms of temperature-dependent resistance.

An example of inventive practice of a single-heater design is as follows. The heater element material is Nichrome (80% Ni, 20% Cr). The electrical resistivity at room temperature is $150e^{-8}$ Ω-m. The temperature coefficient of electrical resistivity is 0.0004° $C.^{-1}$.

An example of inventive practice of a two-zone heater design is as follows. In the first zone: The heater element material is Nichrome (80% Ni, 20% Cr). The resistivity at room temperature is $150e^{-8}$ Ω-m. The temperature coefficient is 0.0004° $C.^{-1}$. In the second zone: The heater element material is 304 Stainless Steel. The resistivity at room temperature is $71.3e^{-8}$ Ω-m. The temperature coefficient is 0.0011° $C.^{-1}$. The 0.0011° $C.^{-1}$ temperature coefficient of the second-zone material is a property that will render the second zone more resistive as the inventive device heats up. Subsequently, assuming that the two zones are wired together in parallel such as shown in FIG. 28, the second zone will generate less heat as time goes on. Conversely, if the two zones are wired together in series (not shown), then the second zone will generate more heat as time goes on.

Candidate resistive heating materials for inventive practice include but are not limited to the following: Silicon (temperature coefficient is −0.07° $C.^{-1}$); Germanium (temperature coefficient is −0.05° $C.^{-1}$); Nichrome (temperature coefficient is 0.0004° $C.^{-1}$); Stainless Steel (temperature coefficient is 0.001° $C.^{-1}$); Platinum (temperature coefficient is 0.004° $C.^{-1}$); Iron (temperature coefficient is 0.007° $C.^{-1}$); Tungsten (temperature coefficient is 0.005° $C.^{-1}$). For example, according to a two-zone system of inventive practice, the first-zone material can be selected from among Silicon, Germanium, and Nichrome; the second-zone material can be selected from among Stainless Steel, Platinum, Iron, and Tungsten. Note that the temperature coefficients for Silicon, Germanium, and Nichrome are nearly zero, or negative. The temperature coefficients for Stainless Steel, Platinum, Iron, and Tungsten are greater than zero. For many inventive embodiments, it may be preferable to implement various blends of nickel alloys (e.g., Inconel, Nichrome) and various blends of steel alloys (e.g., stainless steel 304, 316), as opposed to materials such as silicon, platinum, iron, tungsten, and germanium.

Figures 31, 32, 33:
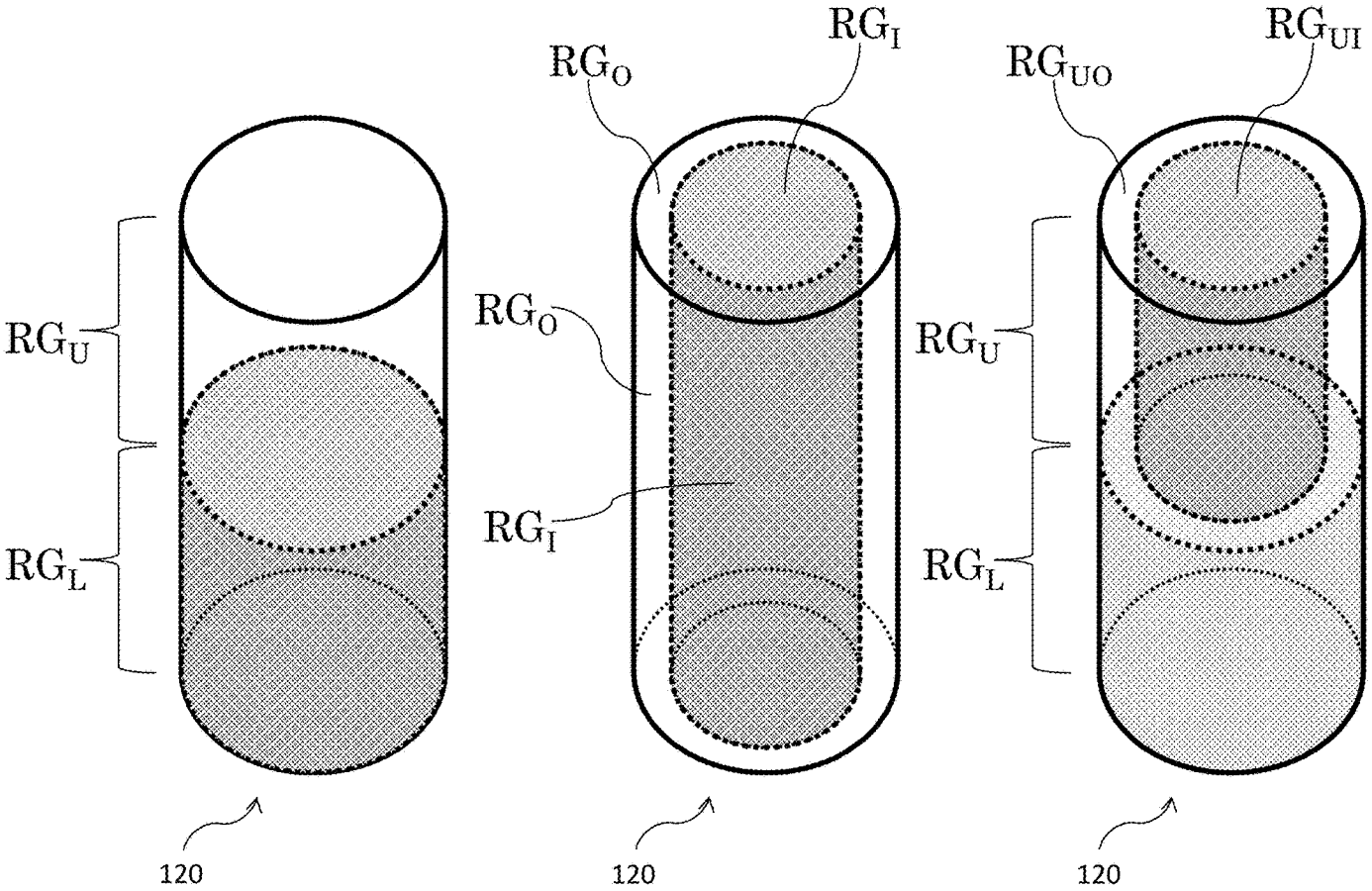
FIGS. 31 through 33 are see-through perspective views of three exemplary embodiments of an inventive simulator. These figures illustrate different strategies of varying material and/or configurative characteristics of different regions of a heater in order to correspondingly vary resistive characteristics and hence thermal characteristics of the regions. It is to be understood by the skilled artisan who reads the instant disclosure that FIGS. 31 through 33 are merely exemplary, and that extremely diverse modes of regionalization are possible in practicing the present invention.

Now referring to FIGS. 31 through 33, it is seen in these and other figures herein that the heating unit 120 describes approximately a cylindrical geometric shape. An inventive practitioner can engineer two or more regions of the cylinder to have varying thermal characteristics. The regionalization can be described by one or more radial delimitations and/or one or more axial-longitudinal delimitations. That is, the thermal heterogeniety can be manifest in a radial direction and/or an axial-longitudinal direction. The variation in thermal characteristics can be accomplished via variation in material and/or variation in configuration (e.g., undulative shape), between or among the regions. Each region can be engineered to have its own unique thermal properties. For instance, thermal properties can be attributed to a particular region that differ from the corresponding thermal properties of one other region, or two or more other regions, or every other region.

FIGS. 31, 32, and 33 show three different examples of thermal regionalization of an inventive heater. FIG. 31 shows an inventive heater having two regions, viz., an upper axial-longitudinal region $RG_U$ and a lower axial-longitudinal region $RG_L$. FIG. 32 shows an inventive heater having two regions, viz., an inner radial region $RG_I$ and an outer radial region $RG_O$. FIG. 33 shows an inventive heater having three regions, viz.: an upper axial-longitudinal, inner radial region $RG_{UI}$; an upper axial-longitudinal, outer radial region $RG_{UO}$; and, a lower axial-longitudinal region $RG_L$.

The lower axial-longitudinal regions $RG_L$ shown in FIGS. 31 and 33, respectively, are each thermally homogeneous. The upper axial-longitudinal region $RG_U$ shown in FIG. 31 is thermally homogenous. The upper axial-longitudinal region $RG_U$ shown in FIG. 33 is thermally heterogeneous, encompassing regions $RG_{UI}$ and $RG_{UO}$. The ordinarily skilled artisan who reads the instant disclosure will appreciate that multifarious variations are possible in practicing thermal regionalization in accordance with the present invention.

The present invention, which is disclosed herein, is not to be limited by the embodiments described or illustrated herein, which are given by way of example and not of limitation. Other embodiments of the present invention will be apparent to those skilled in the art from a consideration of the instant disclosure, or from practice of the present invention. Various omissions, modifications, and changes to the principles disclosed herein may be made by one skilled in the art without departing from the true scope and spirit of the present invention, which is indicated by the following claims.

What is claimed is:

1. A heat simulation device comprising a conductor strip that is emanative of resistive heat, said conductor strip being coiled so as to approximately describe a geometric cylinder, the coiled said conductor strip having different thermal properties at plural different locations of said geometric cylinder, wherein:

said conductor strip is characterized by a length and includes plural longitudinal strip sections along said length, each said longitudinal strip section extending a portion of said length;

said different thermal properties of the coiled said conductor strip at said different locations are associated with different electrical resistances characterizing said conductor strip when said conductor strip is uncoiled so as to be straight in the direction of said length;

a first said longitudinal strip section is characterized by a first said electrical resistance;

a second said longitudinal strip section is characterized by a second said electrical resistance;

the first said electrical resistance and the second said electrical resistance differ from each other.

2. A thermal simulator comprising a substantially cylindrical heater and a substantially cylindrical casing having a geometric axis, said heater including at least two strips and fitting approximately coaxially inside said casing, each said strip being rolled up in a generally cylindrical form and including an electrically conductive resistance-heating element that extends approximately the length of said strip, a first said strip including a first said resistance-heating element, a second said strip including a second said resistance-heating element, the first said resistance-heating element being characterized by a first electrical resistance when the first said strip is straightened in the direction of its said length, the second said resistance-heating element being characterized by a second electrical resistance when the second said strip is straightened in the direction of its said length, said first electrical resistance and said second electrical resistance differing from each other, wherein when electrical current is conducted through said at least two strips each rolled up in said generally cylindrical form said heater is characterized by a heater electrical resistance that differs in at least two regions of said heater, a first said region of said heater being characterized by a said heater electrical resistance in accordance with said first electrical resistance, a second said region of said heater being characterized by a said heater electrical resistance in accordance with said second electrical resistance, said heater thereby exhibiting different thermal characteristics in said at least two regions of said heater.

3. The thermal simulator of claim 2 wherein said at least two strips are radially adjacent.

4. The thermal simulator of claim 2 wherein said at least two strips are axially adjacent.

5. The thermal simulator of claim 2 wherein at least one said strip includes electrical insulation that substantially covers said resistance-heating element and that extends approximately the length of said strip.

6. The thermal simulator of claim 2 wherein each said strip includes electrical insulation that substantially covers said resistance-heating element and that extends approximately the length of said strip.

7. The thermal simulator of claim 2 wherein said heater includes at least one insulative separator, each said insulative separator rolled up together with a said strip so as to prevent self-contact of said strip.

8. The thermal simulator of claim 7 wherein each said strip:

has associated therewith a said insulative separator;

includes electrical insulation that substantially covers said resistance-heating element and that extends approximately the length of said strip.

9. The heat simulation device of claim 1, wherein:

the first said longitudinal strip section includes a first resistive heating element;

the second said longitudinal strip section includes a second resistive heating element;

said first resistive heating element has a first material composition;

said second resistive heating element has a second material composition;

said first material composition and said second material composition differ from each other;

said first material composition is characterized by the first said electrical resistance;

said second material composition is characterized by the second said electrical resistance;

the difference between the first said electrical resistance and the second said electrical resistance is associated with the difference between said first material composition and said second material composition.

10. The heat simulation device of claim 1, wherein:

the first said longitudinal strip section includes a first resistive heating element;

the second said longitudinal strip section includes a second resistive heating element;

said first resistive heating element is characterized by a first undulative structural shape, said first resistive heating element describing a longitudinal waveform profile along a surface of said first resistive heating element;

said second resistive heating element is characterized by a second undulative structural shape, said second resistive heating element describing a longitudinal waveform profile along a surface of said second resistive heating element;

said first undulative structural shape and said second undulative structural shape differ from each other;

said first undulative structural shape is characterized by the first said electrical resistance;

said second longitudinal strip section is characterized by the second said electrical resistance;

the difference between the first said electrical resistance and the second said electrical resistance is associated with the difference between said first undulative structural shape and said second undulative structural shape.

11. The heat simulation device of claim 10, wherein:

said longitudinal waveform profile described by said first resistive heating element is a first square waveform profile;

said longitudinal waveform profile described by said second resistive heating element is a second square waveform profile;

said first square waveform profile and said second square waveform profile differ from each other.

12. The thermal simulator of claim 2 wherein:

said first resistance-heating element is characterized by a first pair of opposite surfaces and a first cross-sectional area between said first pair of opposite surfaces;

said second resistance-heating element is characterized by a second pair of opposite surfaces and a second cross-sectional area between said second pair of opposite surfaces;

said first cross-sectional area and said second cross-sectional area differ from each other;

said first electrical resistance is related to said first cross-sectional area;

said second electrical resistance is related to said second cross-sectional area.

13. The thermal simulator of claim 12 wherein:

said first cross-sectional area is characterized by a first undulating pattern;

said second cross-sectional area is characterized by a second undulating pattern;

said first undulating pattern and said second undulating pattern differ from each other.

14. The thermal simulator of claim 2 wherein:

said first undulating pattern is a first square waveform pattern;

said second undulating pattern is a second square waveform pattern;

said first square waveform pattern and said second square waveform pattern differ from each other.

15. The thermal simulator of claim 13 wherein:

said first undulating pattern and said second undulating pattern each define a repetition of transverse portions of said strip along the length of said strip;

said first undulating pattern and said second undulating pattern differ from each other with respect to at least one of: thicknesses of said transverse portions; distances between said transverse portions.

16. The thermal simulator of claim 15 wherein:

said first undulating pattern is a first square waveform pattern;

said second undulating pattern is a second square waveform pattern;

said first square waveform pattern and said second square waveform pattern differ from each other.

17. The thermal simulator of claim 2 wherein:

said first resistance-heating element is characterized by a first material composition;

said second resistance-heating element is characterized by a second material composition;

said first material composition and said second material composition differ from each other, said first electrical resistance is related to said first material composition;

said second electrical resistance is related to said second material composition.

18. A method for simulating heat characteristics of a battery, the method comprising:

providing at least two strips, each said strip including an electrically conductive resistance-heating element that extends approximately the length of said strip, a first said strip including a first said resistance-heating element, a second said strip including a second said resistance-heating element, the first said resistance-heating element being characterized by a first electrical resistance when the first said strip is in a straightened condition in the direction of its said length, the second said resistance-heating element being characterized by a second electrical resistance when the second said strip is in a straightened condition in the direction of its said length, said first electrical resistance and said second electrical resistance differing from each other;

fitting said at least two strips approximately coaxially inside an approximately cylindrical casing having a geometric axis, wherein said fitting includes coiling each said strip in a generally cylindrical form;

conducting electrical current through said at least two strips while each said strip is rolled up in said generally cylindrical form inside said casing, wherein a first said region of said at least two strips is characterized by said first electrical resistance, and a second said region of said heater is characterized by said second electrical resistance, said at least two strips thereby exhibiting different thermal characteristics in said at least two regions of said at least two strips.

19. The method for simulating of claim 18 wherein said fitting of said at least two strips includes positioning said at least two strips so as to be adjacent to each other in an axial direction.

20. The method for simulating of claim 19 wherein said fitting of said at least two strips includes positioning said at least two strips so as to be adjacent to each other in a radial direction.

* * * * *